US006659151B2

(12) United States Patent
Samaranch Fontcuberta

(10) Patent No.: US 6,659,151 B2
(45) Date of Patent: Dec. 9, 2003

(54) COMPACT DISC (CD) LABELING APPARATUS

(75) Inventor: Luis Samaranch Fontcuberta, Barcelona (ES)

(73) Assignee: CD Team Direct, S.L., Barcelona (ES)

( * ) Notice: Subject to any disclaimer, the term of this patent is extended or adjusted under 35 U.S.C. 154(b) by 0 days.

(21) Appl. No.: 09/971,809

(22) Filed: Oct. 5, 2001

(65) Prior Publication Data

US 2002/0079062 A1 Jun. 27, 2002

(30) Foreign Application Priority Data

Oct. 5, 2000 (ES) ..... 200002429 U

(51) Int. Cl.[7] ..... B65C 1/00; B65C 1/02; B65C 9/26; B65C 9/36

(52) U.S. Cl. ..... 156/391; 156/556; 156/580; 156/DIG. 1; 156/DIG. 2; 156/DIG. 37

(58) Field of Search ..... 156/391, 556, 156/580, DIG. 1, DIG. 2, DIG. 34, DIG. 42

(56) References Cited

U.S. PATENT DOCUMENTS 5,783,033 A * 7/1998 Grossman ..... 156/556

FOREIGN PATENT DOCUMENTS

| | | | | |
|---|---|---|---|---|
| AU | 52145 | * | 8/1996 | ..... B65C/1/02 |
| DE | 29610120 U1 | * | 11/1996 | ..... B65C/1/02 |
| GB | 2351273 A | * | 12/2000 | ..... B65C/9/26 |
| WO | WO 9826986 A1 | * | 6/1998 | ..... B65C/9/26 |
| WO | WO 9914129 A2 | * | 3/1999 | ..... B65C/9/26 |

* cited by examiner

*Primary Examiner*—Richard Crispino
*Assistant Examiner*—Sue A. Purvis
(74) *Attorney, Agent, or Firm*—Steinberg & Raskin, P.C.

(57) ABSTRACT

This apparatus comprises an annular disk supporting the label and allowing to axially shift in its inside a support being provided for supporting the compact disc. This apparatus is characterised in that the annular disk forms at its central opening an integrally formed neck extending downwards and being provided to have its open bottom secured to a base plate from whose central portion an integrally formed upright pin projects upwards and beyond the top surface of the support being provided for supporting the compact disc, said support integrally extending downwards in the shape of a spring resting on the base plate. The support being provided for supporting the compact disc has an axial passage being apt to guide it on the pin of the base plate.

5 Claims, 1 Drawing Sheet

COMPACT DISC (CD) LABELING APPARATUS

FIELD OF THE INVENTION

A compact disc (CD) labeling apparatus

BACKGROUND OF THE INVENTION

Different models of compact disc (CD) labeling apparatuses have been in existence for several years, some of them being fairly simplified but of imperfect operation, whereas others are more complex and achieve a correct centering between the compact disc and the label.

All of these known apparatuses do generally comprise an annular disk supporting the label to be stuck, a compact disc support being apt to be axially shifted within said annular disk.

BRIEF SUMMARY OF THE INVENTION

This invention has as its object an apparatus being provided to fulfil the above-mentioned function and at the same time being of a very simple construction since it is made up of only three components, said apparatus nevertheless in a practical and efficient way assuring the perfect and concentric application and adhesion of the label to the compact disc.

With this apparatus a perfect operation is hence obtained within the scope of its operability, said apparatus being of a much lower cost as compared with others having a similar operation since because of having less components the present apparatus requires a lesser number of moulds having to be manufactured (the members are of plastics material) as well as a smaller amount of time for the assembly of the members composing it, these latter only requiring an attaching operation to be carried out between two of them.

The apparatus is for such a purpose characterised by having a construction being made up of an annular disk integrally forming at its central opening a neck extending downwards and being provided to have its open bottom secured to a base plate from whose central portion an integrally formed upright pin projects upwards and beyond the top surface of the support being provided for supporting the compact disc, said support integrally extending downwards in the shape of a spring resting on the base plate.

The support being provided for supporting the compact disc has an axial passage being apt to guide it on the pin of the base plate, said support besides having its outer periphery provided with a shoulder abutting with another shoulder of the inner periphery of the neck of the annular disk.

These and other characteristics will be best made apparent by the following detailed description whose understanding will be made easier by the accompanying sheet of drawings showing a practical embodiment cited only by way of an example not limiting the scope of the present invention.

DETAILED DESCRIPTION OF PREFERRED EMBODIMENTS

Figure 1:
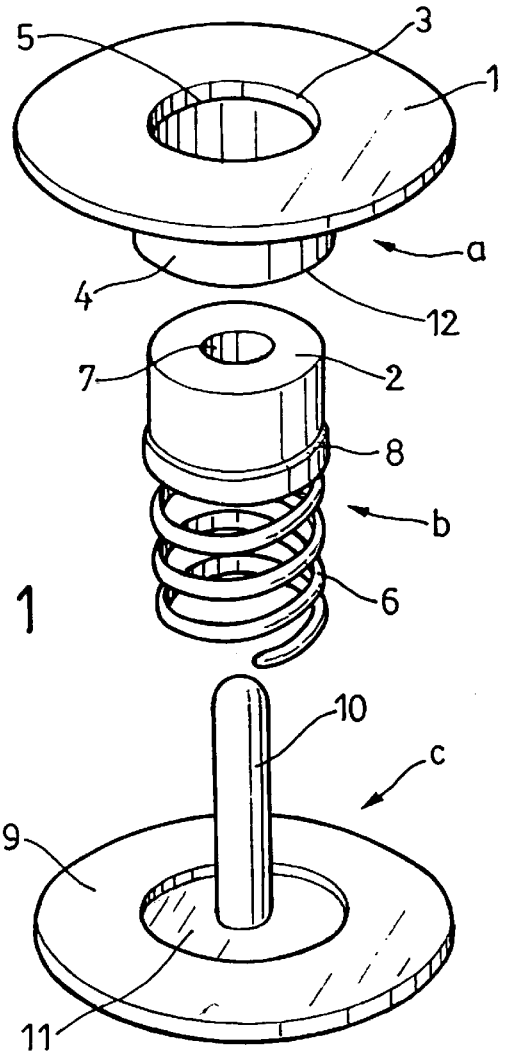
FIG. 1 illustrates in a perspective view the three members making up the apparatus.

According to the drawings this compact disc (CD) labeling apparatus comprises an annular plate 1 supporting the label E and allowing to axially shift in its inside a support 2 being provided for supporting the compact disc D.

This apparatus is characterised by its construction being made up of three members a, b and c being made of moulded plastics material and of which the first one a constitutes the annular disk 1 at its central opening 3 forming a neck 4 extending downwards and having its inner periphery provided with a shoulder 5.

The second member b constitutes the support 2 being provided for supporting the compact disc and extending downwards in the shape of a spring 6, said support 2 having an axial passage 7 and also having its outer periphery provided with a shoulder 8 abutting against the shoulder 5 of member a.

The third member c is formed by a base plate 9 from whose central portion an upright pin 10 projects upwards and is partially surrounded by the axial passage 7 of member b, this latter being thus guided along said pin, the top end of this latter projecting from the top surface of said support 2. The base plate 9 has a centrally located, recessed portion 11 to which the neck 4 of member a is at its open bottom 12 fitted and secured by means of an adequate adhesive.

Figure 2:
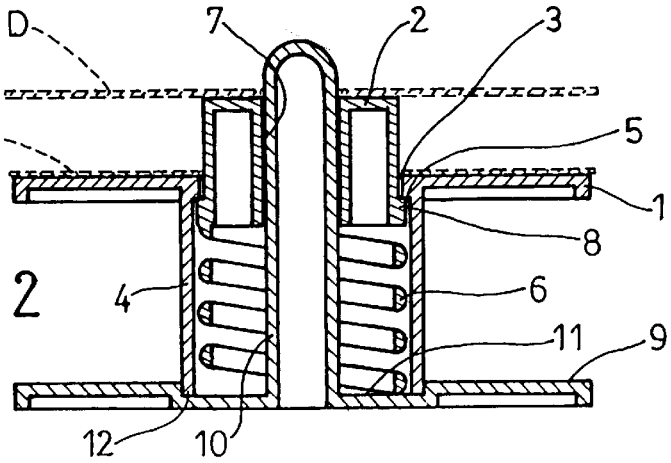
FIG. 2 shows in a sectional elevation the already assembled apparatus ready for operation.

In FIG. 2 the apparatus has been illustrated in its inactive position in which the support 2 being provided for supporting the compact disc projects from the central opening of the annular disk 1, said support being held in said position by the spring 6 and having its shoulder 8 abutting against the shoulder 5 of the neck of the annular disk 1, the top end of pin 10 also projecting above said support 2.

The operation is very simple: when pressing the support 2 downwards this latter will slide while being guided between neck 4 and pin 10, the compact disc D thus being applied against the label E, this latter being thus stuck to the former, said label for such a purpose having its surface to be stuck to the compact disc provided with a glue or adhesive being for example of the contact adhesive type.

Upon cessation of the manual action on support 2 the elastic recovery of spring 6 takes place thus lifting said support with the already labelled compact disc.

What is claimed is:

1. An apparatus for applying labels to compact disks, comprising:

an annular disk having a neck extending therefrom, said neck defining a central orifice;

a support member having a main body and an integrally molded spring portion extending from said main body, said main body defining a central through bore and said spring portion defining an axially extending passage, said main body of said support member being inserted into said central orifice so that a portion of said main body extends above a top surface of said annular disk;

a base portion having a pin extending therefrom, said pin being structured and arranged to pass through said axially extending passage of said spring portion and said central through bore of said main body;

wherein said base portion is coupled to said annular disk and said support member is securely arranged between said base and said annular disk.

2. The apparatus for applying labels to compact disks as in claim 1, wherein said base portion is coupled to said annular disk by means of an adhesive.

3. The apparatus for applying labels to compact disks as in claim 1, wherein said base portion defines a recessed center portion structured and arranged to receive said neck of said annular disk.

4. The apparatus for applying labels to compact disks as in claim 1 wherein said spring is in contact with said base portion.

5. The apparatus for applying labels to compact disks as in claim 1, wherein said annular disk includes a shoulder portion in an inner periphery of said neck and said support member includes an outwardly radially extending lip, wherein said outwardly radially extending lip is structured and arranged to abut said shoulder portion.

* * * * *